United States Patent [19]

Clark

[11] 4,339,007

[45] Jul. 13, 1982

[54] PROGRESSING CAVITY MOTOR GOVERNING SYSTEM

[75] Inventor: Wallace Clark, Indianapolis, Ind.

[73] Assignee: Oncor Corporation, Houston, Tex.

[21] Appl. No.: 172,128

[22] Filed: Jul. 25, 1980

[51] Int. Cl.[3] ..... E21B 3/12

[52] U.S. Cl. ..... 175/107; 175/317; 418/48

[58] Field of Search ..... 175/107, 232, 317; 418/48; 415/502

[56] References Cited

U.S. PATENT DOCUMENTS

| | | | |
|---|---|---|---|
| 2,865,602 | 12/1958 | Whittle | 175/107 |
| 3,194,325 | 7/1965 | Gianelloni | 175/107 |
| 3,753,628 | 8/1973 | Becker | 418/48 |
| 3,802,515 | 4/1974 | Flamand | 415/502 |
| 4,220,380 | 9/1980 | Crase | 175/107 |
| 4,275,795 | 6/1981 | Beimgraben | 175/107 |

FOREIGN PATENT DOCUMENTS

| | | | |
|---|---|---|---|
| 443156 | 11/1974 | U.S.S.R. | 418/48 |

*Primary Examiner*—William F. Pate, III

*Attorney, Agent, or Firm*—Frost & Jacobs

[57] ABSTRACT

There is disclosed a control system for a hydraulic down-hole earth drilling motor of the helical gear pair type to control the pressure drop of the fluid through the motor so that it does not become excessive. A housing is provided defining a chamber, one end of the housing being secured to the outer member housing of the motor. Valve means and pressure controlling means are positioned in the chamber. Linkage means positioned within the chamber joins the valve means pressure controlling means and the upper end of the inner member of the motor. In operation the inner member of the motor may be caused to operate the valve means to control the fluid flow and therefore the pressure drop through the motor in order to protect the motor from overload. A further embodiment of the invention corrects an additional problem in down-hole motors resulting from the back flow when the drilling is stopped for any reason.

20 Claims, 5 Drawing Figures

PROGRESSING CAVITY MOTOR GOVERNING SYSTEM

BACKGROUND OF THE INVENTION

Motors and pumps operating upon the principles invented by R. J. L. Moineau, for example U.S. Pat. No. 1,892,217 of Dec. 27, 1932, and Clifford Allen, for example, U.S. Pat. Nos. 3,512,904 of May 19, 1970 and 3,938,744 of Feb. 17, 1976, are now quite well known. In all cases, these involve a fluid motor composed of a helical gear pair wherein an inner member has one or more exterior helical threads and a cooperating outer member has one or more internal helical threads, the number of helical threads on the inner and outer members differing by one. Moineau motors have been used nearly 20 years for drilling oil, gas and water wells in which the motor is placed down-hole at the bottom of the drill-string of pipe, the purpose being to have the power near the work being done as well as to save wear and tear on the drill stem, which does not necessarily need to be rotated, and also to allow the motor to be directed for the purpose of changing the path of the bore-hole in a manner known as "directional drilling". However, the life of the motor has been inherently greatly shortened by the fact that such a motor generally has a resilient outer member in contact with the hydraulic force of the fluid pumped down from the surface, producing the power output to cut the hole. To prevent fast wear of the resilient outer member, or in fact destruction in a matter of minutes, it is necessary to control the pressure drop of the fluid through the motor so that it does not become excessive.

The present art in making elastomeric compounds for outer member molding limits the pressure drop in the common drilling motor sizes on the order of 300 pounds per square inch of fluid pressure. Accordingly, during operation the operator endeavors to keep up to this pressure in order to drill at optimum penetration rate, as time savings are economically most important. Heretofore, the operator has had no way to accurately know the pressure drop of the fluid through the motor, so the operator has held the drill off bottom, then set it down on bottom and noted the pressure rise on his pump output showing the input down the drillpipe, allowing it to rise, perhaps, 300 pounds per square inch above what it was when he checked it with the drill just off bottom. As most of the pressure is used to circulate the fluid down to the bottom and return, to keep the cuttings removed, to keep the walls of the bore hole conditioned to prevent loss in the circulation as well as preventing blowouts from formation pressure; and, as the required pressure is escalating with every downward movement in penetration, the operator must constantly revalue and adjust to be sure he is not destroying the motor and yet that he is getting maximum work therefrom. As can be expected, the tendency has been to prematurely wear out the motor at the resulting increased expense and thus to restrict its use to special situations such as directional drilling, with return to conventional drilling without the motor as soon as possible because of the lack of a control system for its operation.

BRIEF SUMMARY OF THE INVENTION

The present invention provides a control system for a progressing cavity hydraulic down-hole earth drilling motor of the helical gear pair type. The control system is based on the fact that there is a relation between the inner member thrust and the pressure drop through the motor, and inversely with its accompanying torque, which by a linkage between the inner member, supported by a disc-type of spring having great capacity and known as a Bellville Spring, the inner member will be caused to operate a valve to control the flow and therefore the pressure drop through the motor in order to protect it from overload. Overload will not only fail to occur, but the action of protection accomplished by the system will inform the operator at the surface by having his pressure gauge rise and his drilling penetration rate fall simultaneously. The operator will be able to correct the condition quickly by lifting up some of the weight on the bit, which is at the bottom of the drill string below the motor. With his increasing the tension on his hoist, continuing drilling without having to stop and recalculate what his pressure should be, whilst the motor has been protected, the control system has rendered a most valuable service. The operator knows when his pressure gauge goes back to normal and his penetration rate increases, that he is operating the motor safely and properly at maximum capacity.

In a further embodiment of the present invention the problem in down-hole motors resulting from back flow when the drilling is stopped for any reason has been corrected. On stopping drilling such a back flow, caused by the higher gravity in the annulus especially at the lower end, usually brings a slurry of cuttings into the bearing area and even into the motor. In this embodiment, the back pressure, releasing the thrust of the rotor, will apply pressure to the underside of the valve seat part, and the Bellville Spring will release tension so the valve will close or dampen the back flow quickly. Thus, there is incorporated a back flow check valve which will eliminate the need of a normally used float valve in the bit sub.

DETAILED DESCRIPTION

Figure 1:
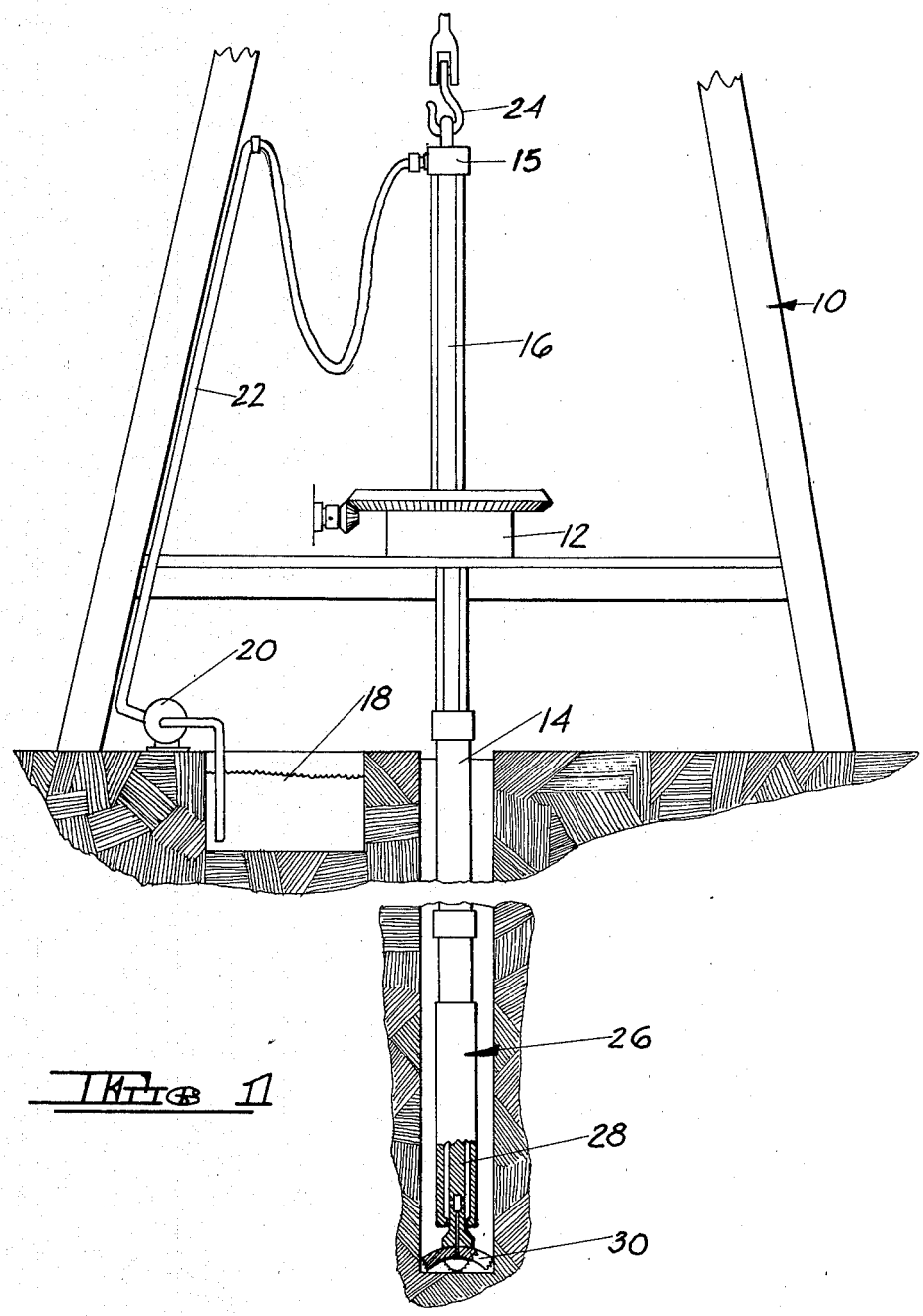
FIG. 1 is a somewhat diagrammatic view of a portion of a drilling rig showing how the various parts are used. A Rotary Table is shown diagrammatically secured to the drill string whereby the drill string may be rotated.

Turning first to FIG. 1, a conventional drilling rig for earth boring operations is indicated generally at 10 and the rotary table is indicated at 12. The drill pipe 14 is either held from rotation or caused to rotate by means of the polygonal kelly 16 which operates in a mating aperture in the rotary table 12. A supply of so-called drilling mud is provided at 18 and pumped by means of a pump 20 through a line 22, drilling swivel 15 and down through the kelly 16 into the drill pipe 14. The kelly 16 and drill pipe 14 are supported from a hoist (not shown) by means of a hook 24. The down-hole motor is diagrammatically indicated at 26 and the drill shaft is shown at 28 secured to the drill bit 30.

Figure 2B:
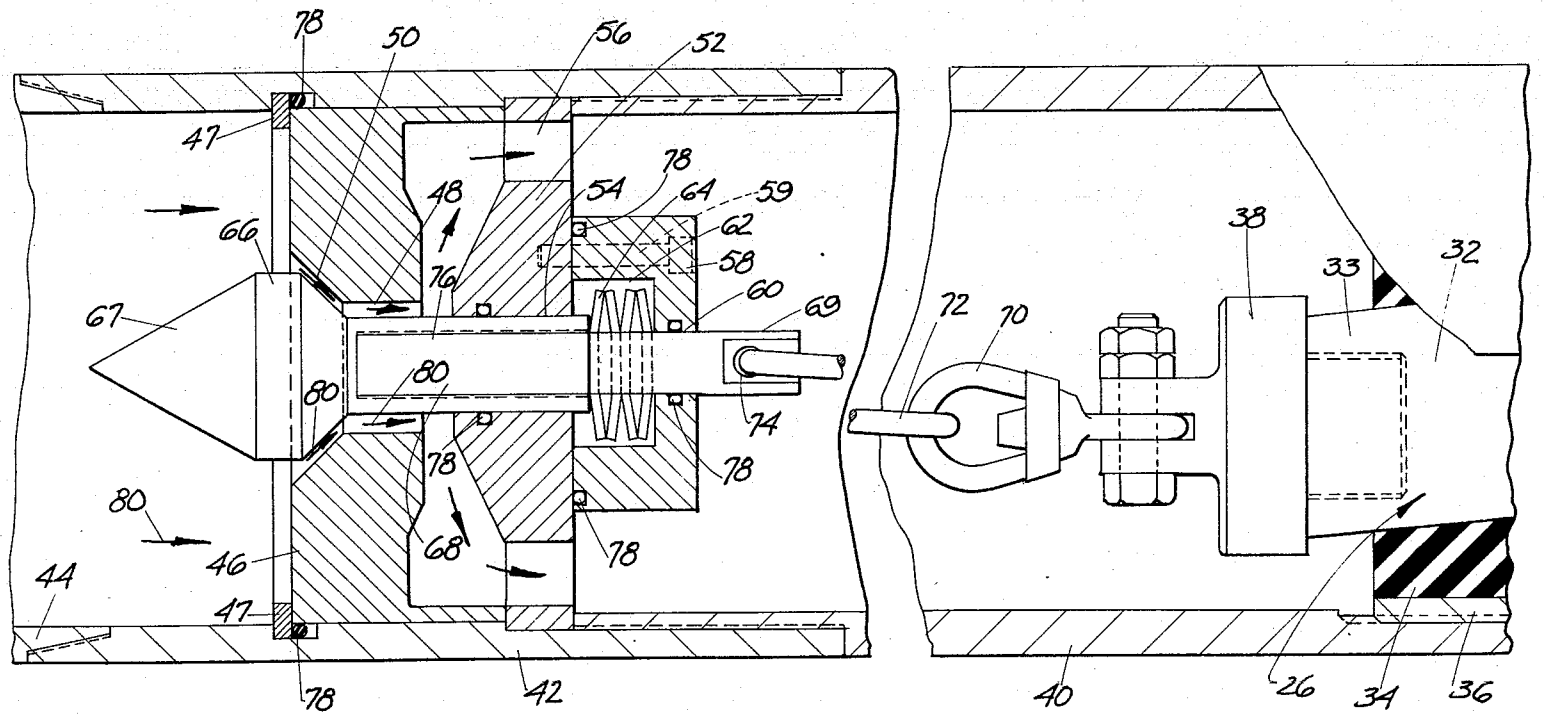
FIG. 2 is a fragmentary longitudinal cross sectional view showing one embodiment of the control system of the present invention.

Turning now to FIG. 2, the inner member 32 of the down-hole motor 26 and the outer member 34 of elastomeric material are shown encased in a housing 36. A plug 38 is fastened to the tail 33 of the inner member 32 in the center of its cross section. This is preferable to mounting the plug 38 at the lathe center as more material surrounds the plug 38, the lathe center being off center to the cross section center. It will, of course, be understood that there would be a difference in the motions of these centers even though both rotate. This is so because the lathe center orbits around the center of the outer member 34 while the cross section center moves reciprocatingly in a straight line in the case of a Moineau type motor while Allen describes an orbitting cross section of the inner member.

The outer member housing 36 of the down-hole motor 26 is secured to a connecting rod or cable housing 40, which is in turn attached to a valve housing 42. The valve housing 42 and the conventional drill stem are attached at the upper end of the drill assembly at 44.

A valve seat member 46 having a central aperture 48 therethrough provided with a valve seat 50 is secured in the valve housing 42, as for example by the snap ring 47. A thrust support member 52 having a central aperture 54 coaxial with the aperture 48 in the valve seat member 46 and with a plurality of peripheral ports 56 is mounted in the valve housing 42 below the valve seat member 46. A spring housing 58 having a central aperture 60 coaxial with the apertures 48 and 54 of the valve seat member 46 and thrust support member 52, respectively, is secured to the thrust support member 52 by bolts 59 and forms a chamber 62 for receipt of a load cell or spring having great capacity, such as one or more disc-type springs 64 commonly known as Bellville Springs.

A valve 66, having a flow deflector 67 which may or may not be used as desired, and provided with a valve stem 68, is operatively associated with the valve seat 50, with the valve stem 68 extending through the coaxial apertures 48, 52 and 60 of the valve seat member 46, the thrust support member 52 and the spring housing 58, respectively, as well as the disc-type spring(s) 64, which may be single or in pairs as shown.

It will, of course, be understood that the threading 76 joining the two pieces of the valve stem 68 is provided in order to finally assemble the parts and locate the inner member of the motor at the proper axial position within the outer member, so that the head of the inner member (not shown) particularly is at its proper place near outer member lower end (not shown) so that it can travel longitudinally within the spring limitation on receiving thrust from fluid flow when in operation.

A well known swivel 70, which may have any of the common bearing adaptations incorporated therein, is secured to the plug 38. A connecting member, which may be rigid, such as the connecting rod 72 of FIG. 2 or non-rigid, such as the cable 72A of FIG. 3, joins the swivel 70 to the end 69 of the valve stem 68, with the rigid connecting rod 72 being joined to the valve stem 68 by means of a non-rigid connection 74.

Seals such as "O" rings 78 provide satisfactory sealing of parts.

During operation the inner member 32 will be caused to operate the flow valve 66 to control the flow (as indicated by the arrows 80) and therefore the pressure drop through the down-hole motor 26 in order to protect it from overload. As previously indicated herein, this is based on the fact that there is a relation between the inner member 32 thrust and the pressure drop through the motor 26 (diagrammatically shown in FIG. 4), which by linkage, such as the swivel 70, the connecting rod 72 and the non-rigid connection 74, between the inner member 32, all operate the valve 66. Overload will not only fail to occur but, with a properly calibrated Belville Spring, that action of protection accomplished by the control system of the present invention will also inform the operator at the surface by having his pressure gauge rise and the bore hole penetration rate fall simultaneously. The operator will be able to correct the condition by quickly lifting up some of the weight on the drill bit 30, continuing drilling without having to stop and recalculate what his pressure should be, while the motor 26 has been protected. The operator knows that when the pressure gauge goes back to normal and his penetration rate increases, that he is operating the motor 26 safely and at a maximum safe capacity.

Figure 3:
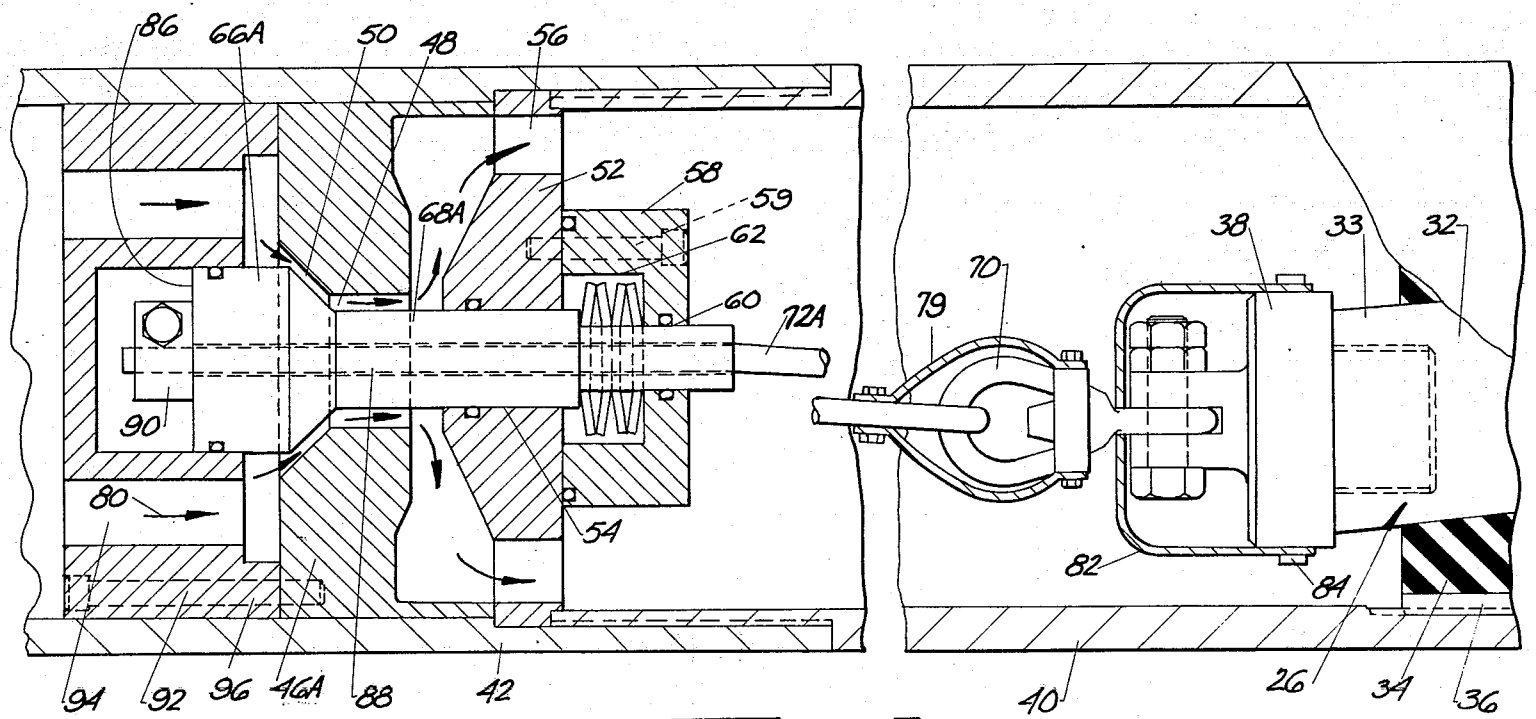
FIG. 3 is a view similar to FIG. 2 showing another embodiment thereof.

FIG. 3 discloses a further embodiment of the control system of the present invention which corrects an additional problem in down-hole motors 26 resulting from back flow when the drilling is stopped for any reason. The problem results because on stopping drilling, the back flow caused by the higher specific gravity in the annulus, especially at the lower end, usually brings a slurry of cuttings into the bearing area and even into the motor 26.

The embodiment of FIG. 3 differs from FIG. 2 in the following respects. The swivel 70 of FIG. 3 while identical with the swivel 70 of FIG. 2, is encircled by a protective boot 79. Similarly, the plug member 38 is provided with a boot or cap 82 affixed thereto by a plurality of screws, shown at 84.

The valve 66A is identical with the valve 66 except that its top end is flat, providing a surface 86, and an axial bore 88 extends through the valve stem 68A. The connecting member comprises a cable 72A, one end of which is secured to the swivel 70 and the other end of which extends through the axial bore 88 in the valve 66A and valve stem 68A, with its free end extending beyond the surface 86 and engaged by a cable clamp 90 which abuts the surface 86. A housing or cover 92 is provided over the valve seat member 46A and area of the cable clamp 90. The cover 92 is provided with apertures 94 communicating with the aperture 48 through the valve seat member 46A. The cover 92 is fastened to the valve seat member 46A by means of the screws 96 and moves with it. The valve seat member 46A is not prevented from moving axially upward along with the cap 92 over it, to close the valve 66A against the valve seat 50 when it acts as a back flow or check valve, as it could be termed.

The cable 72A is used in place of the connecting member rod 72, with the assembly adjustment of the inner member, positioned axially, obtained by manually pulling on the cable 72A and clamping the cable clamp 90 against the surface 86 at the top of the valve 66A. In this manner threads 76 are not needed nor is a two part valve stem 68, as shown in FIG. 2.

Figure 4:
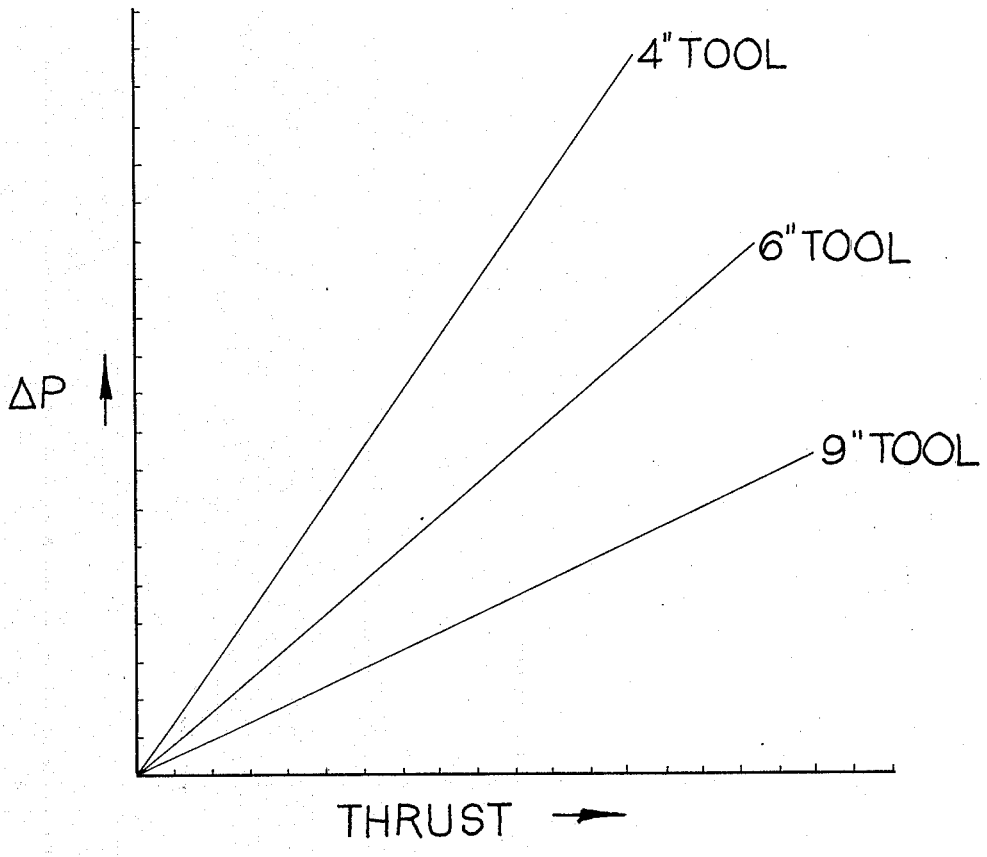
FIG. 4 is a diagram of the relationship between thrust and torque of three practical sizes of motor driven devices used in oil and gas well drilling, mining and like boring.

FIG. 4 is a diagram showing the relation between inner member thrust to torque from resulting pressure drop in three practical sizes of Monieau motor drive devices used in oil and gas well drilling, mining and like boring showing "curves" of the force of the inner member thrust in an example of an actual drill in relation to the curve of the pressure drop at the lower end of the motor before reaching the tool, such as a bit 30 that might be attached to the output shaft 28 to work in a well bore as in drilling, milling or reaming. The vertical line is scaled to represent the escalating degrees of power as the pressure drop in fluid increases with greater input and loading, denoted as Delta P. The horizontal line indicates the resulting increase of thrust between the inner and outer members 32 and 34, respectively, of the motor 26, indicated by its scaling.

As there is a direct relationship, the "curve" will appear as a straight line, as shown. The line will be at an angular position as the cross section of the two motor members impede the fluid flow and are thus producing torque. Three practical sizes of down-hole motors are indicated, built in housings of 4 inch, 6 inch and 9 inch outside diameters. Obviously larger thrust is obtained in relation to pressure drop with larger tools. This must be taken into consideration in the spring loading requirement of the valve above the motor in the control system of this invention.

The curves of FIG. 4 will be made by the manufacturer in order to determine the required operation of the valve 66 or 66A in order to deliver the proper amount of flow under any amount of momentary load, in other words to control the flow into the motor and thus its pressure drop, and after so determining to be able to select the required size of valve and opening, the strength and number of springs 62 in the stack, therefore the length and travel of the valve stem 68 or 68A, and obviously the length of the spring housing 58, in order to perform the proper function in any particular size and power of drill suiting the operator.

Figure 5:
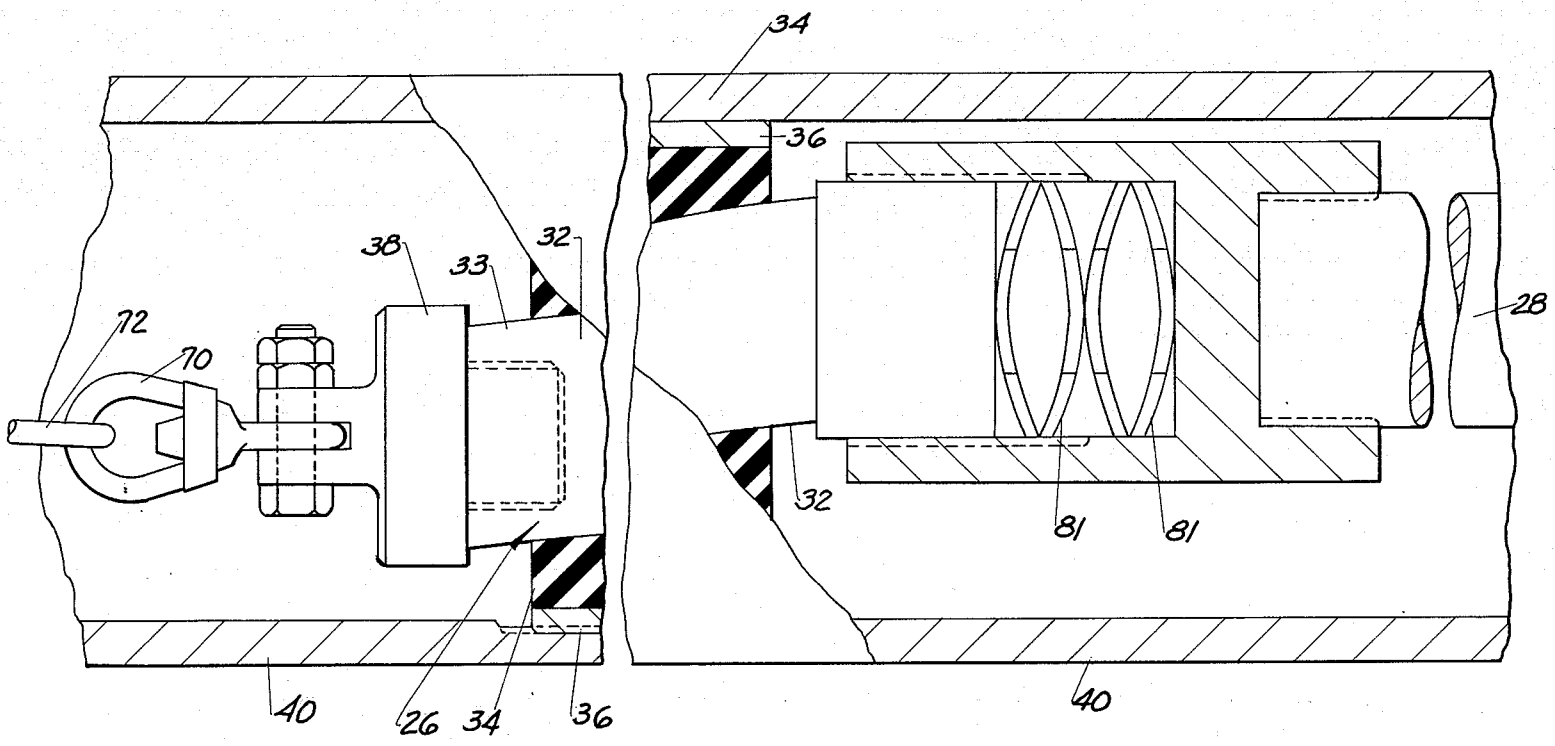
FIG. 5 is a fragmentary longitudinal cross-sectional view showing the use of a Belleville Spring between the inner motor member and the drill shaft.

It will be understood that modifications may be made without departing from the spirit of the invention and no limitation which was not expressly set forth in the claims should be implied and no such limitation is intended. For example, if desired and as seen in FIG. 5, part of the spring loading may be accomplished with the disc-type spring 81 (Bellville Spring) also under the inner motor member 32 and between it and the drill shaft 28, so as to partly compensate the thrust in order to make the work lighter on the valve stem above the connecting cable on the top end of the inner motor member, and thus to reduce the required size of the cable. Additionally, it will be understood that the position of the swivel 70 and the non-rigid connection 74 are interchangeable with respect to the connecting rod 72 and the cable 72A.

What is claimed is:

1. In an hydraulic down-hole earth drilling motor of the progressive cavity helical gear pair type constituted by an inner member having one or more external helical threads and a cooperating outer member having one or more internal helical threads, the number of helical threads on the inner and outer members differing by one, said outer member having an outer member housing into which hydraulic fluid is pumped down from the surface to drive said motor, a control system to control the pressure drop of the fluid flowing through said motor so that it does not become excessive, comprising a valve housing defining a chamber, one end of said valve housing being secured to said outer member housing of said motor; valve means positioned within said valve housing chamber to control the flow of fluid through said valve housing, said valve means being movable from an open to a closed position; pressure controlling means positioned within said valve housing chamber to normally bias said valve means toward the open position; and linkage means positioned within said valve housing chamber and joining said valve means and the upper end of said inner member, whereby axial displacement of said inner member acts to operate said valve means to control the fluid flow and therefore the pressure drop through said motor in order to protect said motor from overload.

2. The motor according to claim 1, wherein said valve means comprises a valve seat member secured in said housing, said valve seat member having a central aperture therethrough provided with a valve seat on the up-hole side thereof; a thrust support member having a central aperture coaxial with said valve seat member aperture and provided with a plurality of peripheral ports mounted in said housing below said valve seat member; a controller housing having a central aperture coaxial with said valve seat member and thrust support member apertures secured to the down-hole side of said thrust support member and forming a chamber therein, said pressure controlling means being positioned in said controller housing chamber; and a valve having a valve head operatively associated with said valve seat and extending through said coaxial apertures of said valve seat and thrust support members and said housing and operatively associated with said pressure controlling means.

3. The motor according to claim 2, wherein said pressure controlling means comprises at least one disc-type spring and said valve stem extends therethrough, with said spring acting against said controller housing and a flange on said valve stem.

4. The motor according to claim 3, wherein said valve stem comprises two pieces, one of which is threadedly received within the other in order to finally assemble the parts and place said inner member at the proper axial position within said outer member, so that the head of said inner member is at its proper place near the outer member lower end so that it can travel outward within the spring limitation of said disc-type spring on receiving thrust from fluid flow when in operation.

5. The motor according to claim 4, wherein said linkage means comprises a rigid connection rod one end of which is attached by a non-rigid connection to the up-hole end of said valve stem and the other end thereof to the upper end of said inner member.

6. The motor according to claim 5, wherein the upper end of said inner member is provided with a swivel and the other end of said connection rod is non-rigidly secured thereto.

7. The motor according to claim 6, wherein the upper end of said inner member is provided with a plug and said swivel is attached to said plug.

8. The motor according to claim 7, wherein said swivel is encircled by a protective boot.

9. The motor according to claim 8, wherein said plug is provided with a protective cap.

10. The motor according to claim 9, wherein said valve head is provided with a flow deflector.

11. The motor according to claim 2, wherein the top end of said valve head is flat, providing a surface, and an axial bore extends through said valve head and said valve stem, said linkage means comprises a non-rigid member one end of which is secured to the upper end of said inner member and the other end of which extends through said axial bore, with its free end extending beyond said surface of said valve head and engaged by a clamp which abuts said surface, said valve seat not being prevented from moving axially upward to close said valve head against said valve seat and act as a back flow valve to preclude backflow when the drilling is stopped.

12. The motor according to claim 11, wherein a housing is provided over said valve seat member and area of said clamp, said housing being provided with apertures therethrough communicating with said valve seat member aperture.

13. The motor according to claim 12, wherein said pressure controlling means comprises at least one disc-type spring and said valve stem extends therethrough with said spring acting against said housing and a flange on said valve stem.

14. The motor according to claim 11, wherein said non-rigid member comprises a cable, with the assembly adjustment of said inner member positioned axially by pulling on said cable and clamping said clamp against said valve head surface.

15. The motor according to claim 14, wherein the upper end of said inner member is provided with a swivel and one end of said cable is non-rigidly secured thereto.

16. The motor according to claim 15, wherein the upper end of said inner member is provided with a plug and said swivel is attached to said plug.

17. The motor according to claim 16, wherein said swivel is encircled by a protective boot.

18. The motor according to claim 17, wherein said plug is provided with a protective boot.

19. The motor according to claim 1, wherein one end of the inner member of the helical gear pair is operatively connected to the drill shaft driven by said motor, and additional pressure controlling means interposed between the said end of the inner member and the drill shaft.

20. The motor according to claim 19, wherein said additional pressure controlling means comprises at least one disc-type spring.

* * * * *